United States Patent [19]

Behling

[11] Patent Number: 4,999,938

[45] Date of Patent: Mar. 19, 1991

[54] CONVERTIBLE MESSAGE SIGN

[75] Inventor: Dennis P. Behling, Livonia, Mich.

[73] Assignee: Marketing Displays, Inc., Farmington Hills, Mich.

[21] Appl. No.: 42,535

[22] Filed: Apr. 24, 1987

Related U.S. Application Data

[63] Continuation of Ser. No. 743,742, Jun. 12, 1985, abandoned.

[51] Int. Cl.[5] ..... G09F 10/00

[52] U.S. Cl. ..... 40/610; 40/612; 40/608; 40/602; 248/624

[58] Field of Search ..... 40/610, 606, 607, 612, 40/603, 584, 530, 605, 598, 908, 600, 588, 492, 608, 602; 248/624, 160, 125, 354, 377; 116/28 R, 173, 107; 362/319; 272/11; 296/95 R

[56] References Cited

U.S. PATENT DOCUMENTS

| | | | |
|---|---|---|---|
| 65,673 | 6/1867 | Holland et al. | 160/354 |
| 349,526 | 9/1886 | Seavey | 272/11 |
| 1,076,257 | 10/1913 | Wiltz | 40/530 |
| 1,444,522 | 2/1923 | Dedlar | 160/377 |
| 1,520,896 | 12/1924 | Wadsworth | 40/605 |
| 1,626,913 | 5/1927 | Brown | 116/107 |
| 1,873,178 | 8/1932 | Bernstein | 40/603 |
| 2,064,393 | 12/1936 | Talbott | 296/95 R |
| 2,437,444 | 3/1948 | Strofe | 116/173 |
| 2,501,044 | 3/1950 | Gianelloni, Jr. | 40/533 |
| 2,681,030 | 6/1954 | Hoge | 40/610 |
| 2,855,890 | 10/1958 | Sprenger et al. | 116/173 |
| 2,862,552 | 12/1958 | Franz | 248/125 |
| 3,091,215 | 5/1963 | Kenmore | 116/173 |
| 3,200,786 | 8/1965 | Swezy et al. | 116/173 |
| 3,219,010 | 11/1965 | Hyatt | 116/28 R |
| 3,256,629 | 6/1966 | Whitman | 40/610 |
| 3,288,412 | 11/1966 | Murphy | 248/125 |
| 3,472,198 | 10/1969 | Rinecker | 40/908 |
| 3,481,060 | 12/1969 | Hartz | 40/588 |
| 3,496,666 | 2/1970 | Morley | 40/530 |
| 3,518,782 | 7/1970 | Long | 40/588 |
| 3,557,479 | 1/1971 | Allison et al. | 40/610 |
| 3,616,557 | 11/1971 | Vara, Sr. | 40/610 |
| 3,873,821 | 3/1975 | Larson | 362/319 |
| 3,899,843 | 8/1975 | Doyle et al. | 40/612 |
| 4,094,083 | 6/1978 | Fund | 40/588 |
| 4,176,485 | 12/1979 | Terris | 40/612 |
| 4,246,715 | 1/1981 | Nelson | 40/612 |
| 4,318,238 | 3/1982 | Macarle, Jr. | 40/612 |
| 4,426,800 | 1/1984 | Brown | 40/610 |
| 4,433,935 | 2/1984 | Main et al. | 248/125 |
| 4,471,548 | 9/1984 | Goudie | 40/610 |
| 4,530,175 | 7/1985 | Wellman | 40/530 |

FOREIGN PATENT DOCUMENTS

| | | | |
|---|---|---|---|
| 52158 | of 0000 | Fed. Rep. of Germany | 116/173 |
| 1267373 | 6/1961 | France | 40/908 |
| 1450058 | 7/1966 | France | 40/612 |
| 506697 | 12/1954 | Italy | 40/612 |
| 1496046 | 12/1977 | United Kingdom | 40/584 |
| 1526855 | 10/1978 | United Kingdom | 40/610 |

*Primary Examiner*—James R. Brittain
*Assistant Examiner*—J. Hakomaki
*Attorney, Agent, or Firm*—Brooks & Kushman

[57] ABSTRACT

A construction or emergency sign with a changeable message on its front surface. The sign has a diamond shape or a square shape and one or more flaps are secured along the central diagonal of the sign. The flaps are adapted to be releasably fastened to either of two opposite corners of the sign and have messages on both sides. When the flaps are secured in one corner, a first message is presented and when the flaps are secured in the other corner, a second message is presented. A pair of cross-braces hold the sign in a taut planar configuration. The sign is also adapted to be collapsed into a small, compact package for transport and storage. One embodiment of the sign has two or more flaps thus allowing three or more different messages to be presented. Another embodiment has an additional cross-brace allowing the sign to be used to present either diamond or square-shaped messages.

9 Claims, 4 Drawing Sheets

FIG. 1.
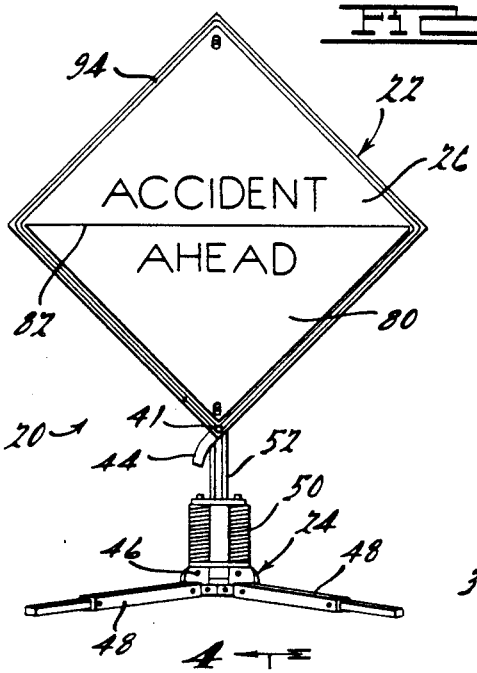
FIG. 2.
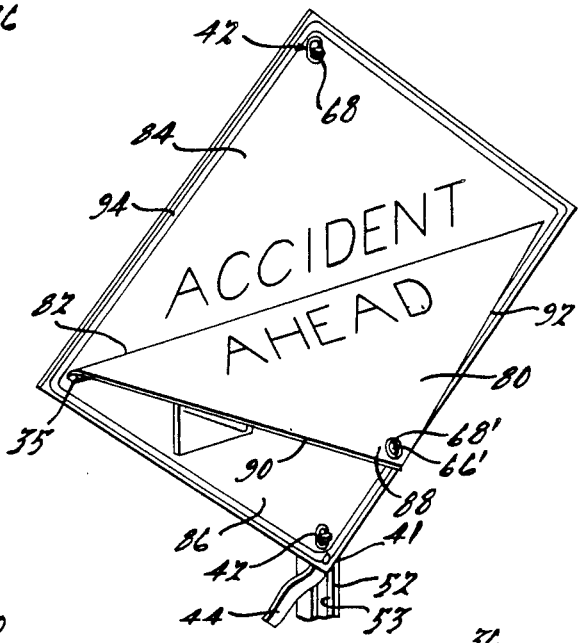
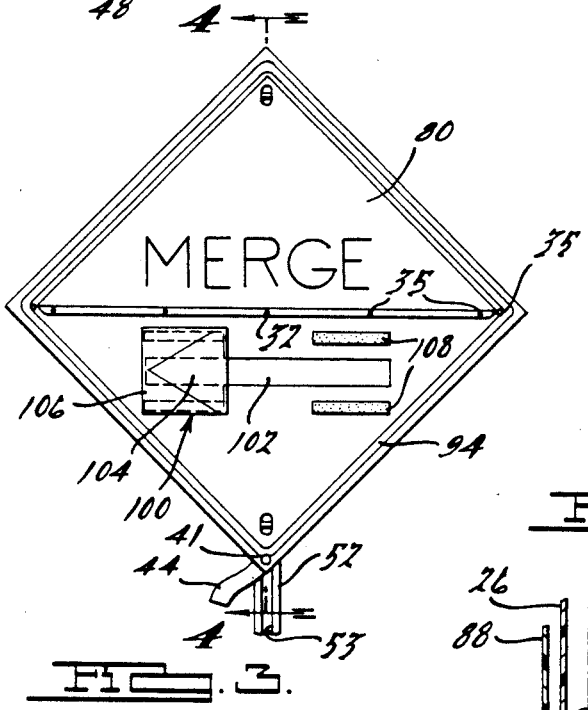
FIG. 3.
FIG. 4.
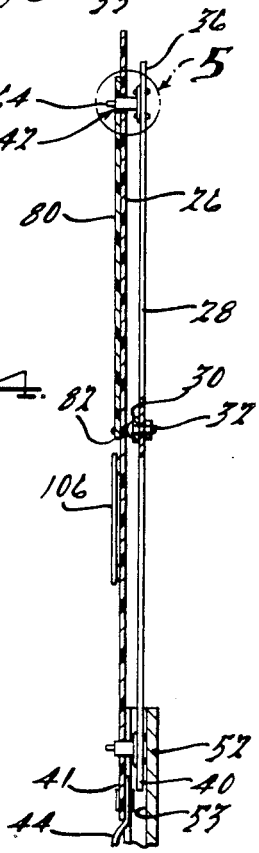
FIG. 5.
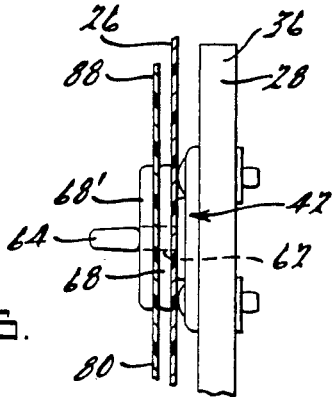

CONVERTIBLE MESSAGE SIGN

This is a continuation of U.S. patent application Ser. No. 743,742, filed June 12, 1985.

BACKGROUND AND SUMMARY OF INVENTION

This invention relates to signs and sign stand devices for displaying warnings or other pertinent messages, and more particularly to an improved roadside sign of the foldable or roll-up variety. Temporary signs are particularly desirable for warning approaching or passing motorists of upcoming hazards such as are presented by construction work or emergency situations. Since such traffic hazards can occur anywhere, it is desirable that these roadside signs be easily transported from one location to another and be foldable and collapsible for easy storage and transport. It is also desirable for such signs to be compact and lightweight and further that each sign have the ability to display more than one message to accommodate a variety of situations so that a large number of different signs do not have to be transported within a vehicle with its limited storage capacity.

Compact, lightweight, easily portable and easily assembled warning devices are a necessity for emergency use and are highly preferred for temporary use. At accident scenes, for example, police and other emergency vehicles need to provide a warning to other approaching traffic, slow the traffic down, and direct it safely around the accident site. Due to the limited space available in police and emergency vehicles for warning and message signs, it is desirable to have a single sign be capable of displaying a number of different messages that can be used depending on the conditions (type of road, number of traffic lanes, volume of traffic, etc.).

The warning device should also be small enough to fit easily in the police or emergency vehicle without taking up too much space and yet be large enough in use to be seen easily by approaching motorists. The device should also be highly visible at night and usable in all weather conditions. The same size and weight considerations also apply to temporary sign equipment for utility and road construction vehicles.

It is known today to use signs made of heavy-duty flexible material, such as reinforced cloth, vinyl, or plastic, with a pair of cross-braces used to hold the sign panel taut in a planar configuration for use. Known signs are also adapted to be collapsible and rolled up into compact packages for transportation and storage. It is also known to provide sign stand assemblies for such signs which have springs or resilient mechanisms to prevent the sign stands from being dislodged or tipped over in high winds. Signs and sign stands having one or more of these features are shown, for example, in the following patents and patent applications, all of which are assigned to the same assignee as the present invention: U.S. Pat. Nos. 3,646,696, 3,662,482, 4,033,536, 4,288,053 and 4,507,887; and copending application Ser. Nos. 274,400, filed June 17, 1981, No. 442,378, filed Nov. 17, 1982, No. 573,193, filed Jan. 23, 1984 and No. 581,550, filed Feb. 21, 1984.

It is an object of the present invention to provide an improved, lightweight, foldable and compact message or legend sign which is capable of convenient storage and transport and which can be quickly and easily set up and mounted on a sign stand for use. It is a further object of the present invention to provide such an improved, foldable and compact sign which is capable of displaying more than one message or legend. It is another object to provide a roll-up sign which is capable of displaying either a diamond-shaped or square-shaped message configuration.

Diamond-shaped signs are used for warning and construction signs. They usually have orange or yellow backgrounds. Square-shaped signs are used for regulatory signs, such as to display the speed limit, notify trucks of weigh stations, etc., and usually have white backgrounds.

In accordance with the present invention, the sign includes a flexible, foldable (roll-up) sign panel and at least two cross-braces. The cross-braces are pivotably secured together and are connected to the four corners of the sign. The connections in at least two of the corners are releasable or unlockable such that the sign panel can be released from the cross-braces, the cross-braces can be folded together, and the sign panel can be rolled up around the cross-braces. The sign has at least one flap member which is approximately one-half the size of the sign and is connected along one of the diagonals of the sign. The flap member is triangular in shape and is adapted to be connected at its free end to either of two opposite corners of the sign panel. The flap member is two-faced with messages contained on both sides. When the flap member is connected to one corner of the sign panel, a first message or legend is presented; and when the flap member is connected to the opposite corner of the sign panel, a second message or legend is presented. The sign also can present either a diamond-shaped warning sign or a square-shaped regulatory sign to approaching traffic. In the latter situation, a third cross-brace is provided. Additional second flap members can also be provided to allow the sign to display three or more messages.

Other objects, features and advantages of the present invention will become apparent from the following description and claims taken in conjunction with the accompanying drawings.

BRIEF DESCRIPTION OF THE DRAWINGS

FIG. 1 is a schematic front view of the inventive roll-up type sign in the display configuration shown with a deflectable base assembly;

FIG. 2 is a perspective view of the inventive sign showing the flap member and changeable message feature;

FIG. 3 depicts the sign of FIG. 1 but showing the second message;

FIG. 4 is a cross-sectional view of the sign of FIG. 3 taken along line 4—4 thereof;

FIG. 5 is an enlarged view of the area shown in the encircled area of FIG. 4 and indicated by the numeral 5;

DETAILED DESCRIPTION OF THE PREFERRED EMBODIMENT

Figure 6:
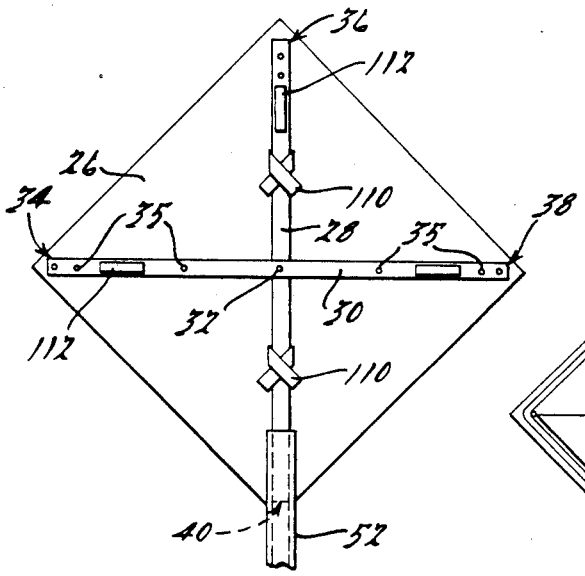
FIG. 6 is a back view of the sign shown in FIGS. 1–5.

The drawings show exemplary embodiments of the preferred invention for purposes of illustration only. One skilled in the art will readily recognize that the principles of the invention are well adapted for use in embodiments other than those specifically shown in the drawings.

FIG. 1 illustrates a front view of the invention in the display position. The sign is generally designated by the reference numeral 20 and consists of a sign 22 and a base or stand assembly 24. The sign 22 has a four-sided sign panel 26 and a pair of cross-braces 28 and 30 (better shown in FIGS. 4 and 6). The cross-braces are pivotably secured to one another by pivot pin 32 at their midpoints and are secured to the four corners of the sign panel 26 at their ends 34, 36, 38 and 40. The ends 34 and 38 of one of the cross-braces 30 are securely fastened to the sign panel 26 in a permanent manner, such as by rivets or other fasteners 35. A plurality of similar fasteners 35 are also provided along the length of the horizontal cross-brace 30 in order to securely hold the sign panel 26 to it. The ends 36 and 40 of the other cross-brace 28 are secured to the sign panel 26 by releasable fasteners, such as by turn-lock mechanisms 42 (shown in FIGS. 4 and 5).

The cross-braces 28 and 30 hold the sign panel in a taut, planar configuration so that the message can be most effectively presented for viewing by passing motorists. When the ends 36 and 40 of the cross-brace 28 are released from the sign panel and the cross-brace 28 is rotated around pivot pin 32 to a position parallel to cross-brace 30, the sign panel 26 can be rolled up around the two cross-braces forming a light, small, compact package for storage and transport. A piece of Velcro material 44 with hook-and-loop fasteners is attached to one corner 41 of the sign panel and adapted for use to wrap around the rolled-up sign and hold it together in a package during storage and transport.

The sign panel 26 is made of a foldable, flexible material, such as plastic or vinyl, which can be rolled up for storage and opened up and held in a taut configuration for presentation. The material also should be durable and weather resistant since the signs are to be used outdoors in virtually all types of weather conditions. The sign panel also should be made of a reflective material at least on the front surface so the sign and message can be viewed easily at night. Finally, the material for the sign panel should have a surface which can be imprinted or silk-screened with the desired message.

Preferably, the sign panels are made of UV-stabilized thin retroreflective vinyl sheeting, heat sealed in a one-inch grid pattern to heavy-duty vinyl coated fabric and silk-screened with a permanent message. Retroreflective sign panels from Reflexite Corporation, New Britain, CT, are satisfactory for use for this application, although any other comparable reflective roll-up sign material could also be utilized.

The cross-braces 28 and 30 are preferably made of a fiber-glass material, although other materials with similar strength and durability properties can be utilized. Fiber-glass is useful because it has the necessary strength and durability properties and is also lightweight.

The base or stand assembly 24 can be any standard or conventional type but preferably is of the type shown in the drawings (FIG. 1) and described in U.S. Pat. Nos. 4,433,935 and 4,507,887, and in co-pending U.S. patent application Ser. No. 442,418, filed Nov. 17, 1982. The stand assembly 24 has a base member 46, four pivoted and outwardly extending ground engaging legs 48, a pair of coil springs 50 and an upright member 52. The upright member 52 has a channel 53 for mating with the lower end 40 of the vertical cross-brace 28. As better described in application Ser. No. 442,418, the cross-brace 28 is slidingly received in the channel 53 in the upright member 52 and can be held in place with a hitch-pin or the like. The coil springs (or other equivalent resilient mechanism) allows the sign 22 to rotate or deflect downwardly in high winds without displacing or turning over the entire sign assembly 20. This is described in more detail in U.S. Pat. Nos. 4,433,935 and 4,507,887, the disclosures of which are hereby incorporated by reference.

The turn-locks or twist-locks 42 are best shown in FIGS. 4 and 5 and are used to releasably connect the sign panel 26 to the ends of the cross-braces, particularly the ends 36 and 40 of vertical cross-brace 28. The turn-lock 42 has a base 60 which is fixedly attached to the cross-brace, upstanding shaft member 62 and a rotatable end member 64. The sign panel 26 has an opening 66 with a protective grommet 68 around it and the opening is positioned to fit over the shaft member 62 of the turn-lock 42 and be held in position by a slight (approximately 90°) rotation of the end member 64. The turn-locks 42 are a quick, convenient and reliable mechanism for connecting the sign panel to the cross-braces. It is also possible, however, to use other mechanisms for fastening the sign panels to the cross-braces, such as snap fasteners or Velcro hook-and-loop fasteners. If Velcro fasteners are utilized, it is preferable to use wraparound strip-type members as disclosed in U.S. Pat. No. 4,507,887.

In order to provide a convertible or changeable message sign, flap member 80 is provided on the front face or surface of the sign panel 26. The flap member 80 is triangular in shape and is stitched, glued or otherwise securedly fastened along one edge 82 to the sign panel. The edge 82 acts as a hinge or pivot line and allows the flap member 80 to be rotated to a position covering the top half 84 of the sign panel 26 or the lower half 86. The two sides of the flap member are made of the same material as the sign panel 26 and, from a distance, the flap appears to be part of the sign panel itself.

The flap member 80 can be secured in either of its two positions by any conventional means, such as snap fasteners or Velcro hook-and-loop fasteners, but preferably is secured through use of turn-locks 42. The shaft members 62 of the turn-locks are lengthened to accommodate two thicknesses of material and an opening 66' with a protective grommet 68' on it is provided in the corner 88 of the flap member 80 to allow the flap to be secured over the turn-lock. A sign panel with the flap member in the upper position and secured by the turn-lock is depicted in FIGS. 3-5.

If the flap member is secured to the sign panel by hook-and-loop fasteners, it is possible to provide a wraparound strap member (not shown) on the corner 88, or strips of fasteners (not shown) along the edges 90 and 92 of the flap member which mate with corresponding strips (not shown) secured to the sign panel.

Where the multiple messages utilize the same color of sign material and legend color, the size of the triangular flap member 80 is preferably not precisely one-half the size of the sign panel 26. Instead, a one-to-two inch strip of the sign panel 26 can be left exposed along the outside edge of the flap member. This utilizes less material creating a savings in cost of the sign materials, and also saves in time and expense of not having to print a border on the flap member. Most construction and warning signs by regulation require a border 94 around their outside edges and if the flap member 80 covered up the border, then another border would have to be imprinted on the flap member too.

The use of the flap member 80 allows the sign to display two completely different messages and thus could allow the purchase, inventory and transport of up to one-half the number of sign panels previously needed. FIGS. 1–6 depict a sign which can display two different messages, the two sign messages being shown in FIGS. 1 and 3. The sign panel 26 is imprinted with the word "ACCIDENT" on its top half and a changeable arrow design mechanism 100 on its lower half. The flap member 80 has the word "AHEAD" on one side and the word "MERGE" on the other. Thus when utilized in the field, the sign 22 of FIGS. 1–6 can display either the phrase "ACCIDENT AHEAD" in order to warn approaching motorists, or the word "MERGE" in combination with an arrow in order to direct the traffic into another lane.

The arrow design mechanism 100 shown in FIG. 3 allows placement of the arrowhead in either of two directions. The shaft of the arrow 102 is imprinted on the sign panel 26 while the arrowhead 104 is contained on a separate piece of material 106. A series of Velcro hook-and-loop fasteners 108 allow placement of the arrowhead in either direction.

A rear view of the sign 22 is shown in FIG. 6. As shown by this view, the vertical cross-brace 28 can be more securely attached to the sign panel 26 by a plurality of hook-and-loop fasteners 110. The fasteners 110 are affixed to the back of the sign panel and have two ends which are adapted to be wrapped around the cross-brace. Also, a number of reflective strips of material 112 can be provided on the cross-braces so that the presence of sign 22 can be visible at night from the opposite side to motorists.

An alternate embodiment of the invention is shown in FIGS. 7–12. Many of the features of this embodiment are the same as those described above with reference to FIGS. 1–6 and are numbered with the same reference numerals. The principal differences between the two embodiments concern the number of flap members and the number of cross-braces.

Figure 7:
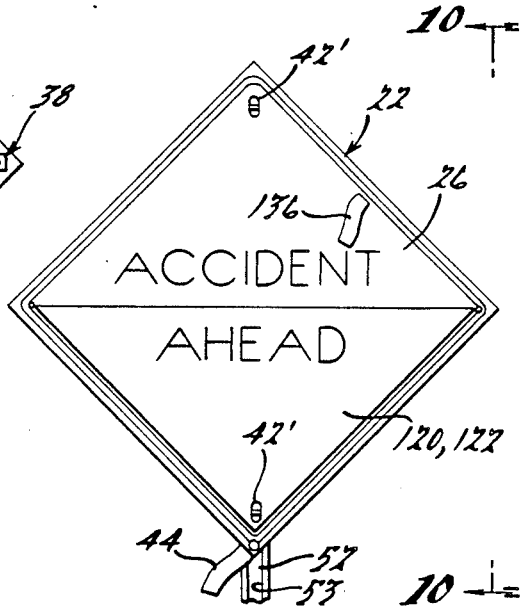
FIGS. 7, 8 and 9 depict a second embodiment of the invention and illustrate the different messages and sign orientations possible such embodiment.
Figure 8:
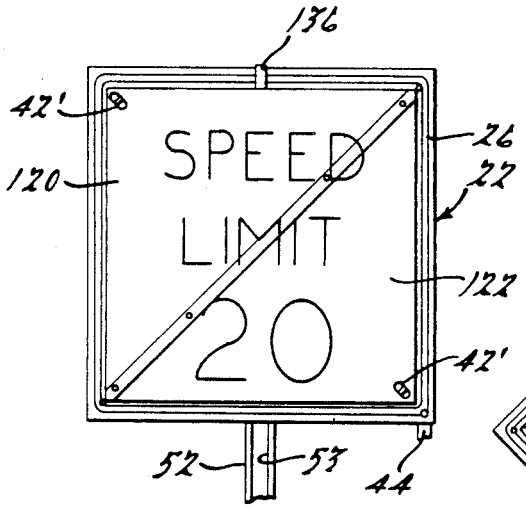
Figure 9:
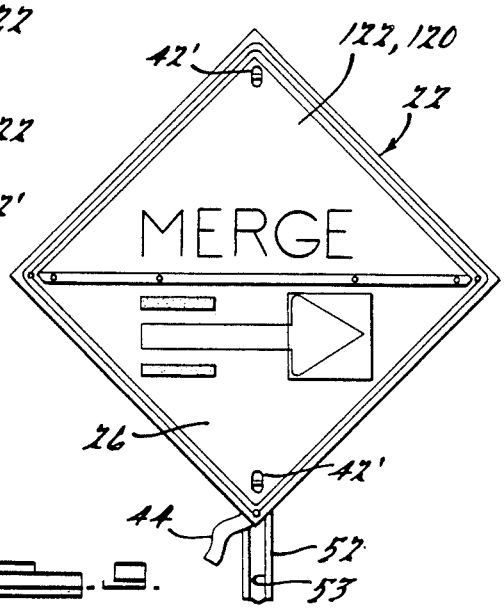

The sign 22 shown in FIGS. 7–12 is a convertible or changeable message sign which is capable of displaying three different messages and also capable of being used both as a square-shaped sign, and a diamond-shaped sign. The three different messages are shown in FIGS. 7, 8 and 9, respectively, with FIGS. 7 and 9 displaying diamond-shaped messages and FIG. 8 displaying a square-shaped message.

The sign panel 26 is substantially the same as that described above. Instead of just one flap member being utilized, however, two flap members 120 and 122 are provided. When both flap members are positioned on the lower half of the sign panel (FIG. 7) the first message ("ACCIDENT AHEAD") is displayed. When both flap members are positioned on the upper half of the sign panel (FIG. 9), the second message ("MERGE" with a direction arrow) is displayed. When the flap member 120 is positioned on the upper half of the sign panel and the other flap member 122 is positioned on the lower half of the sign panel (FIG. 8), the front surface of the sign panel 26 is substantially covered and a third message ("SPEED LIMIT 20") is displayed.

In FIGS. 7–9, the flap members 120 and 122 are shown smaller than one-half the size of the sign panel 26. Where the sign messages require different color backgrounds and/or letters, however, the flap members are sized to substantially cover an entire half of the sign panel. For example, if the diamond-shaped warning signs of FIGS. 7 and 8 have orange backgrounds and the square-shaped regulatory sign of FIG. 8 has a white background, then the two flap members would cover the entire sign panel.

The flap members 120 and 122 are secured in their two positions by turn-locks 42'. The turn-locks 42' are essentially the same as turn-locks 42 described above, but have longer upstanding shaft members in order to accommodate the third layer of sign material. Appropriate openings and grommets are provided on the flap members 120 and 122 in order to mate with and be held in place by the turn-locks 42'.

Figure 10:
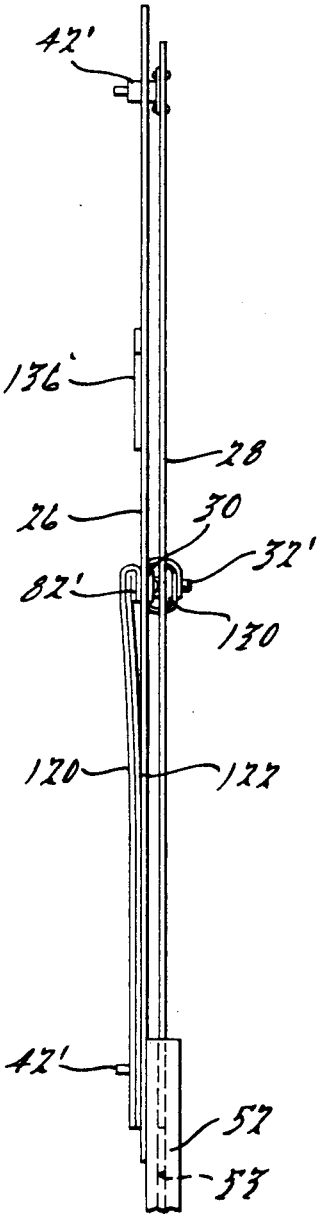
FIG. 10 is a side-elevational view of the sign of FIG. 7 viewed in direction of arrows 10—10 thereof.
Figure 11:
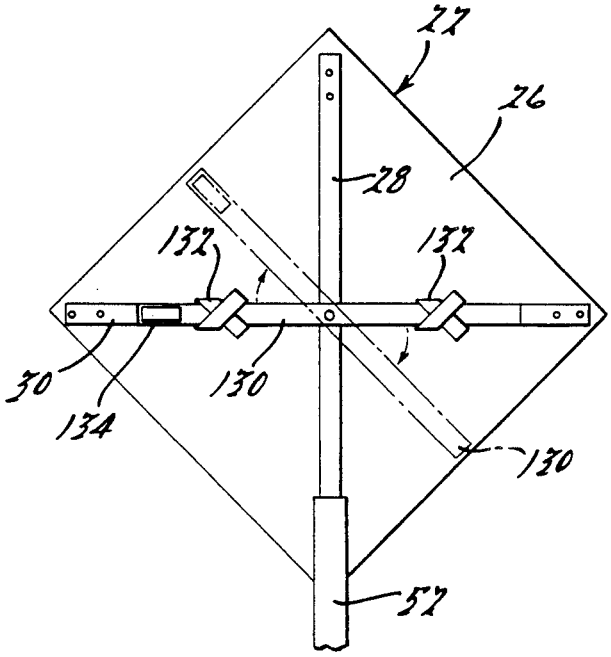
FIG. 11 is a back view of the sign shown in FIGS. 7 and 9.
Figure 12:
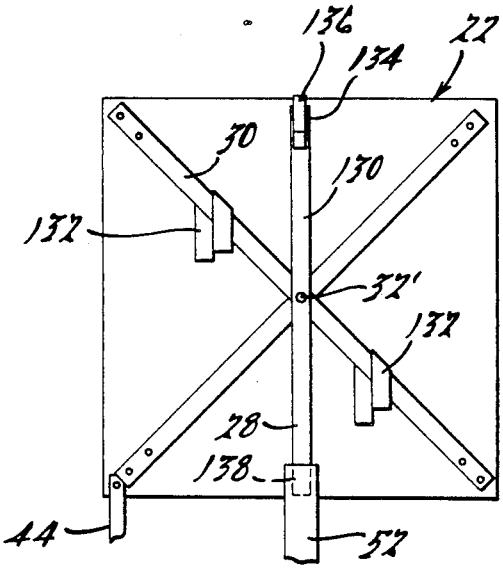
FIG. 12 is a back view of the sign shown in FIG. 8.

As shown in FIGS. 10–12, a third cross-brace 130 is provided. The cross-brace 130 is attached to cross-braces 28 and 30 by pivot pin 32' and is stored in a position parallel to horizontal cross-brace 30 when a diamond-shaped sign is needed. In this regard, hook-and-loop fasteners 132 are affixed to the back of the sign panel and hold the cross-brace 130 in place. When the square-shaped sign display is utilized, the third cross-brace 130 is rotated to the position shown in FIG. 12 and held in place at its upper end 134 by hook-and-loop strip fastener 136 which is looped over the end 134 from the front of the sign panel and connected to the rear face of the cross-brace 130. The lower end 138 of the cross-brace 130 is adapted to be releasably retained in the channel 53 in the upright 52 of the stand member.

Figure 13:
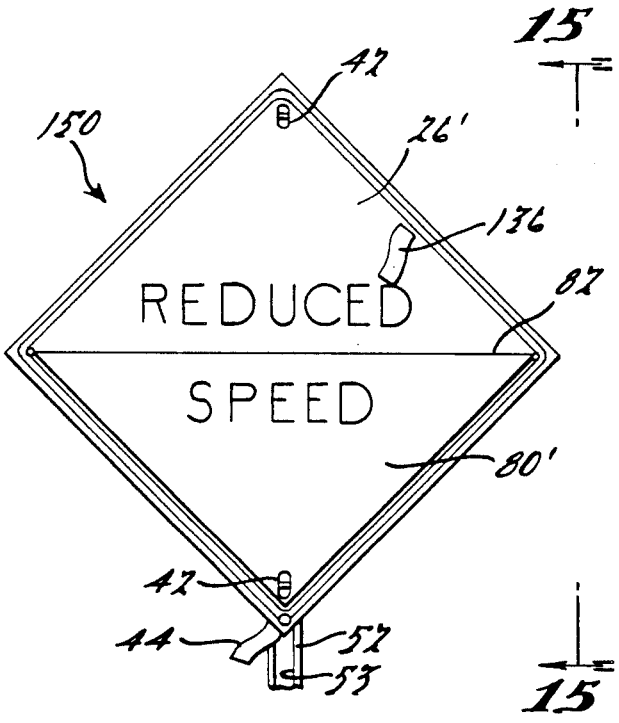
FIGS. 13–15 illustrate another embodiment of the invention, with FIGS. 13 and 14 being front views depicting the alternate messages and sign orientations possible and with FIG. 15 being a side-elevational view of the sign of FIG. 13 viewed in the direction of arrows 15—15 thereof.
Figure 14:
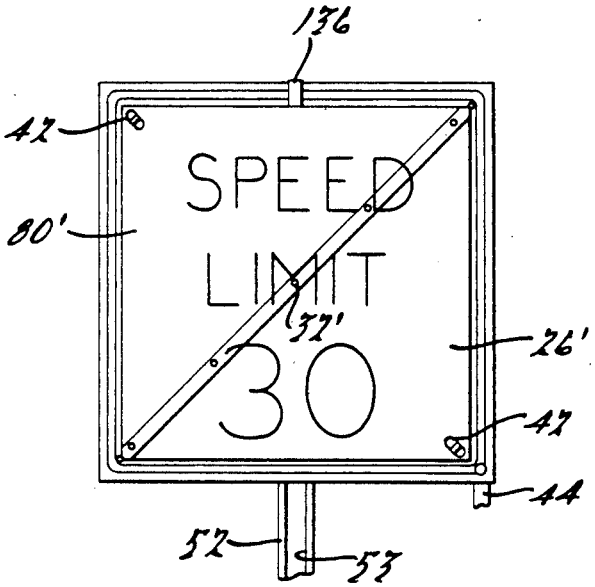
Figure 15:
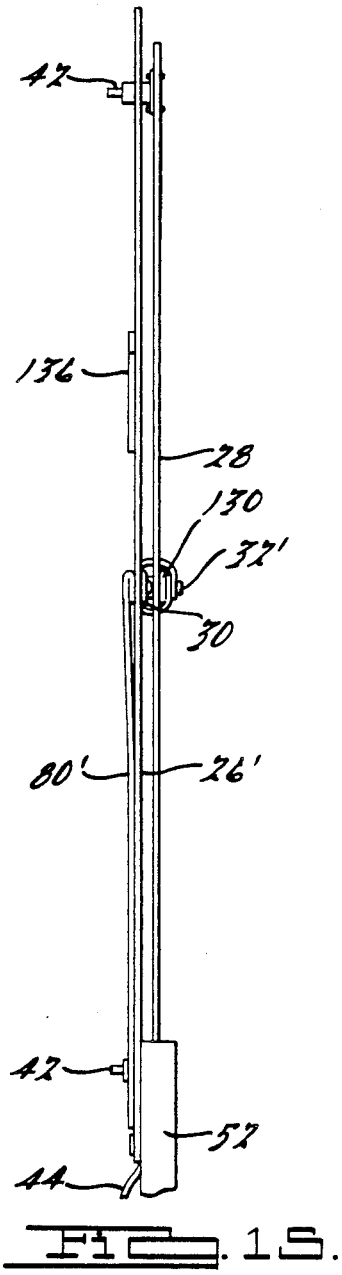

Another embodiment of the invention is shown in FIGS. 13–15. This embodiment 150 is a combination of the two above-described embodiments and contains a single flap member 80' and three cross-braces 28, 30 and 130. This embodiment provides only two messages for display, but allows the use of both a diamond-shape sign message (FIG. 13) and a square-shaped sign message (FIG. 14). When the flap member 80' is in its lower position (FIG. 13), a diamond-shaped message (e.g. "REDUCED SPEED") is provided and only two cross-braces are utilized. When the flap member 80' is in its upper position (FIG. 14), a square-shaped message (e.g. "SPEED LIMIT 30") is provided and all three cross-braces are utilized.

While it will be apparent that the preferred embodiments of the invention disclosed are well calculated to fulfill the objects above stated, it will be appreciated that the invention is susceptible to modification, variation and change without departing from the proper scope or fair meaning of the appended claims.

I claim:

1. A sign comprising a sign panel composed of a foldable and flexible material and a cross-brace means for supporting said sign panel in a generally planar configuration, said sign panel having a front surface with a message thereon for presentation to the passing public, said cross-brace means being releasably secured to said sign panel such that the sign panel and cross-brace means can be collapsed and rolled up into a compact package for storage and transport, the improvement comprising:

a cross-brace means which includes at least three cross-brace members pivotally joined generally at the centers thereof for rotation in a common plane;

at least two flap members being secured to said front surface of said sign panel and allowing at least three different messages to be presented, said flap members being approximately one-half the size of the front surface of the sign panel and being foldable and flexible for rolling up with said sign panel into a compact package for storage and transport; and fastening means for releasably securing said flap members in a first position having, a second position and a third position, said first position having two of said flap members both covering approximately a first one-half of the front surface of the sign panel, said second position one of said flap members covering approximately a first one-half of the front surface of the sign panel and a second of said flap members covering approximately a second one-half of the front surface of the sign panel, said third position having two of said flap members both covering approximately a second one-half of the front surface of the sign panel;

whereby a first message is displayed by the sign panel when the flap members are in said first position, a second message is displayed by the sign panel when the flap members are in said second position and a third message is displayed by the sign panel when the flap member are in said third position.

2. The sign according to claim 1 wherein the corner of each of said flap members is releasably secured to said sign panel by turn-lock fastener means.

3. The sign according to claim 1 wherein the corner of each of said flap members is releasably secured to said sign panel by hook-and-loop means.

4. The sign according to claim 1 further comprising a stand assembly with means for holding said sign in a vertically upright position.

5. The sign according to claim 4 wherein said means for holding said sign comprises a channel means for mating with the end of one of said cross-brace members.

6. The sign according to claim 4 wherein said stand assembly is adapted to be folded into a compact package for storage and transport.

7. The sign according to claim 6 wherein said stand assembly has a plurality of foldable, collapsible leg members.

8. The sign according to claim 4 wherein said stand assembly has resilient means for allowing said means for holding said sign to deflect in high wind conditions.

9. A sign comprising a sign panel composed of a foldable and flexible material and a cross-brace means for supporting said sign panel in a generally planar configuration, said sign panel having a front surface with a message thereon for presentation to the passing public, said cross-brace means being releasably secured to said sign panel such that the sign panel and cross-brace means can be collapsed and rolled up into a compact package for storage and transport, the improvement comprising:

a cross-brace means which includes at least three cross-brace members pivotally joined generally at the centers thereof for rotation in a common plane;

at least one of said cross-brace members having an end disposed adjacent a corner of said sign panel and at least another of said cross-brace members having an end disposed along an edge of said sign panel generally midway between two adjacent corners of said sign panel;

said ends of said cross-brace members being adapted for mounting to a supporting structure to thereby selectively hold said sign panel in a diamond-shaped configuration and alternatively in a square-shaped configuration;

at least two flap members being secured to said front surface of said sign panel and allowing at least three different messages to be presented, said flap members being approximately one-half the size of the front surface of the sign panel and being foldable and flexible for rolling up with said sign panel into a compact package for storage and transport; and fastening means for releasably securing said flap members in a first position, a second position and a third position, said first position having two of said flap members both covering approximately a first one-half of the front surface of the sign panel, said second position having one of said flap members covering approximately a first one-half of the front surface of the sign panel and a second of said flap members covering approximately a second one-half of the front surface of the sign panel;

said third position having two of said flap members both covering approximately a second one-half of the front surface of the sign panel;

whereby a first message is displayed by the sign panel when the flap members are in said first position, a second message is displayed by the sign panel when the flap members are in said second position and a third message is displayed by the sign panel when the flap member are in said third position.

* * * * *

UNITED STATES PATENT AND TRADEMARK OFFICE

CERTIFICATE OF CORRECTION

PATENT NO. : 4,999,938

DATED : March 19, 1991

INVENTOR(S) : Dennis P. Behling

It is certified that error appears in the above-indentified patent and that said Letters Patent is hereby corrected as shown below:

Column 2, line 59, before "such" insert --with--.

Column 2, line 61, before "direction" insert --the--.

Column 7, line 18, after "position" delete --having--.

Column 7, line 22, after "position" insert --having--.

Column 7, line 36, "member" should be --members--.

Column 9, line 54, "member" should be --members--.

Signed and Sealed this

Twenty-first Day of June, 1994

*Attest:*

Bruce Lehman

BRUCE LEHMAN

*Attesting Officer*

*Commissioner of Patents and Trademarks*